US010027073B2

(12) United States Patent
Tokita et al.

(10) Patent No.: US 10,027,073 B2
(45) Date of Patent: Jul. 17, 2018

(54) COAXIAL CONNECTOR WITH ELECTROMAGNETIC SHIELD

(71) Applicant: J.S.T. Mfg. Co., Ltd., Osaka-shi (JP)

(72) Inventors: Hiroshi Tokita, Yokohama (JP); Takashi Tsutsui, Miyoshi (JP)

(73) Assignee: J.S.T. MFG. CO., LTD., Osaka-shi (JP)

( * ) Notice: Subject to any disclaimer, the term of this patent is extended or adjusted under 35 U.S.C. 154(b) by 0 days.

(21) Appl. No.: 15/696,740

(22) Filed: Sep. 6, 2017

(65) Prior Publication Data

US 2018/0076579 A1 Mar. 15, 2018

(30) Foreign Application Priority Data

Sep. 9, 2016 (JP) ..... 2016-176705

(51) Int. Cl.

| | |
|---|---|
| ***H01R 9/05*** | (2006.01) |
| ***H01R 24/38*** | (2011.01) |
| ***H01R 13/506*** | (2006.01) |
| ***H01R 13/58*** | (2006.01) |
| ***H01R 13/6581*** | (2011.01) |
| *H01R 12/59* | (2011.01) |
| *H01R 13/648* | (2006.01) |
| *H01R 13/6598* | (2011.01) |
| *H01R 13/6593* | (2011.01) |
| *H01R 13/6596* | (2011.01) |
| *H01R 13/6592* | (2011.01) |

(52) U.S. Cl.

CPC ..... *H01R 24/38* (2013.01); *H01R 13/506* (2013.01); *H01R 13/5804* (2013.01); *H01R 13/6581* (2013.01); *H01R 9/05* (2013.01); *H01R 12/596* (2013.01); *H01R 13/648* (2013.01); *H01R 13/6592* (2013.01); *H01R 13/6593* (2013.01); *H01R 13/6596* (2013.01); *H01R 13/6598* (2013.01)

(58) Field of Classification Search

CPC ..... H01R 12/596; H01R 24/38; H01R 9/05; H01R 13/648; H01R 13/6581; H01R 13/6593; H01R 13/6596; H01R 13/6592; H01R 13/6598

USPC ..... 439/578, 98

See application file for complete search history.

(56) References Cited

FOREIGN PATENT DOCUMENTS

| | | | |
|---|---|---|---|
| JP | 2006-339021 | A1 | 12/2006 |
| JP | 2013-258108 | A1 | 12/2013 |
| JP | 2013258108 | A * | 12/2013 |

* cited by examiner

*Primary Examiner* — Abdullah Riyami
*Assistant Examiner* — Justin Kratt
(74) *Attorney, Agent, or Firm* — Kratz, Quintos & Hanson, LLP

(57) ABSTRACT

The coaxial connector is provided with a contact, an internal housing, a shell and an electromagnetic shield plate. The contact has a connecting portion which can connect with a mating side contact, and a crimping portion which crimps the central conductor. The internal housing has a contact receiving chamber opened at a rear end portion, and the connector is retained in the contact receiving chamber. The shell has a shell main body covering an external perimeter of the internal housing, and a cable clamp. The cable clamp fixes an end of the coaxial cable. The shell main body has a lock piece. A pair of slits is provided at both sides of the lock piece. The electromagnetic shield plate is disposed at an upper face of the internal housing, and has one piece which shields a portion of the pair of slits with respect to the internal housing.

6 Claims, 13 Drawing Sheets

COAXIAL CONNECTOR WITH ELECTROMAGNETIC SHIELD

This application is based on and claims the benefit of priority from Japanese Patent Application No. 2016-176705, filed on 9 Sep. 2016, the content of which is incorporated herein by reference.

BACKGROUND OF THE INVENTION

Field of the Invention

The present invention relates to a coaxial connector. In particular, the present invention relates to a coaxial connector which is fixed to an end of a coaxial cable, and which can be electrically connected to a mating coaxial connector mounted to a printed circuit board, and to a structure of a coaxial connector which requires measures against EMI (Electro Magnetic Interference).

Related Art

For example, a coaxial connector is constituted of a coaxial plug attached to an end of a coaxial cable, and a receptacle mounted to a printed circuit board. By connecting the coaxial plug to the receptacle, it is possible to transmit a high frequency signal from the coaxial cable to the printed circuit board, or to transmit a high frequency signal from the printed circuit board to the coaxial cable.

Generally, a coaxial cable is constituted of a circular central conductor, a dielectric such as a fluorine-based resin or the like surrounding the perimeter of the central conductor, an outer conductor such as a braided wire or the like surrounding the perimeter of the dielectric, and an insulation sheath which covers and protects the outer conductor.

For example, the coaxial plug according to Japanese Unexamined Patent Application, First Publication No. 2006-339021 (below referred to as Patent Document 1), is provided with a cylindrical external contact, a rectangular tube-shaped external housing, and a concave retainer.

The housing has a contact receiving chamber opened at one side face, and an external contact furnished with a coaxial cable can be inserted into the contact receiving chamber. The end portion of the external contact inserted into this contact receiving chamber has a constitution such that, at one end portion the insulation sheath and the outer conductor of the coaxial cable are crimped, and in addition at the other end portion, a cylindrical insulating member into which the central conductor of the coaxial cable is inserted is crimped from an external circumferential direction thereof.

In the coaxial plug according to Patent Document 1, the rectangular tube-shaped housing cannot be made small, and therefore it is not easy to miniaturize the receptacle. Namely, there is the deficiency that lowering the implementation height of the receptacle, namely height reduction, is not easy. In response to this deficiency, for example, Japanese Unexamined Patent Application, First Publication No. 2013-258108 (below referred to as Patent Document 2) discloses a coaxial receptacle where a height reduction of the receptacle is easy.

In the coaxial connector according to Patent Document 2, the shell covering the internal housing of the contact connecting portion of the coaxial cable is fit to the external housing. This shell has an end portion which projects from the external housing, and which is inserted and connected to the receptacle. A lock piece is provided at an end portion of this shell, and the connection with the receptacle is locked. Further, a lock release lever is provided at the upper face of the external housing, so as to interlock with the above mentioned lock piece of the above mentioned shell fit to the external housing. Namely, by a pushing operation of the lock release lever, the lock piece is deformed, and the locking of the coaxial connector and the receptacle in the connected state is released.

In the above described constitution of the coaxial connector according to Patent Document 2, because of the range of motion of the lock piece of the shell, a pair of slits is cut into a side portion of the lock piece. Therefore, there is concern that a noise signal from the contact may leak through these slits. Also, there is concern that a noise signal may be input to the contact through these slits. The present invention was made in consideration of such problems, and has the objective of providing a coaxial connector provided with measures against EMI, while maintaining compatibility with coaxial connectors of the prior art.

SUMMARY OF THE INVENTION

The present inventors considered that it is possible to suppress the leakage of noise signals from the contact, or suppress the input of noise signals to the contact, by interposing an electromagnetic shield plate which covers an upper face and a rear end portion of the internal housing, between the internal housing and the shell, and based on this, arrived at the invention of a novel coaxial contact provided with measures against EMI, as shown below.

The first aspect of the present invention is a coaxial connector constituting a connecting terminal at an end of a coaxial cable having a central conductor, a dielectric enclosing this central conductor, an outer conductor covering this dielectric, and an insulation sheath sheathing this outer conductor, comprising a contact which is connectable with a mating contact, and which has at one end side a contact connecting portion, and which has at an other end side a crimping portion which can crimp the central conductor, a rectangular tube-shaped internal housing having in its interior a contact receiving chamber which is opened at a rear end portion and which can receive the contact connecting portion with the contact connecting portion as the head, and which retains the contact in the contact receiving chamber, an electrically conductive shell having a rectangular tube-shaped shell main body covering an external circumference of the internal housing, and a cable clamp which continuously projects from the shell main body and which can coaxially fix an end of the coaxial cable to the shell main body, and an L-shaped electromagnetic shield plate interposed between the shell and the internal housing which sheathes a part of the internal housing; wherein the cable clamp comprises a conductor barrel which can crimp the outer conductor, and an insulation grip which can crimp the insulation sheath, the shell main body has a pair of slits at both sides of an upper face, and has a lock piece supported with a cantilever shape at the upper face, and the electromagnetic shield plate is disposed at an upper face of the internal housing, and has one piece which shields a portion of the pair of slits with respect to the internal housing.

The second aspect of the present invention is a coaxial connector according to the first aspect, wherein a rear end portion of the internal housing comprises a first circular opening communicating to the contact receiving chamber and into which the outer conductor can be introduced from an axial direction; the electromagnetic shield plate further comprises an other piece having a second circular opening disposed concentrically with the first circular opening, at a rear end portion of the internal housing, and which can shield the rear end portion of the internal housing.

The third aspect of the present invention is a coaxial connector according to the second aspect, wherein for the electromagnetic shield plate, the one piece and the other piece are continuous in an approximately orthogonal state.

The fourth aspect of the present invention is a coaxial connector according to any one of the first to third aspects, further comprising a rectangular tube-shaped external housing fixed to a rear end side of the shell main body, and having in its central portion a fitting hole into which the shell main body can be inserted, and wherein the external housing has a lock release lever which can be pushed and moved at a front portion of the lock piece.

The fifth aspect of the present invention is a coaxial connector according to the second or third aspect, wherein the coaxial cable further has a barrel-shaped ferrule having conductivity and which compresses the dielectric via the outer conductor, and the electromagnetic shield plate, has at the other piece one or more projecting pieces which intermittently project from an inner perimeter of the second circular opening and contact an external perimeter of the ferrule from an external perimeter direction of the ferrule.

DETAILED DESCRIPTION OF THE INVENTION

Below, embodiments for carrying out the present invention are explained with reference to the drawings.

[Constitution of the Coaxial Connector]

First, the constitution of the coaxial connector according to one embodiment of the present invention is explained.

Figure 1:
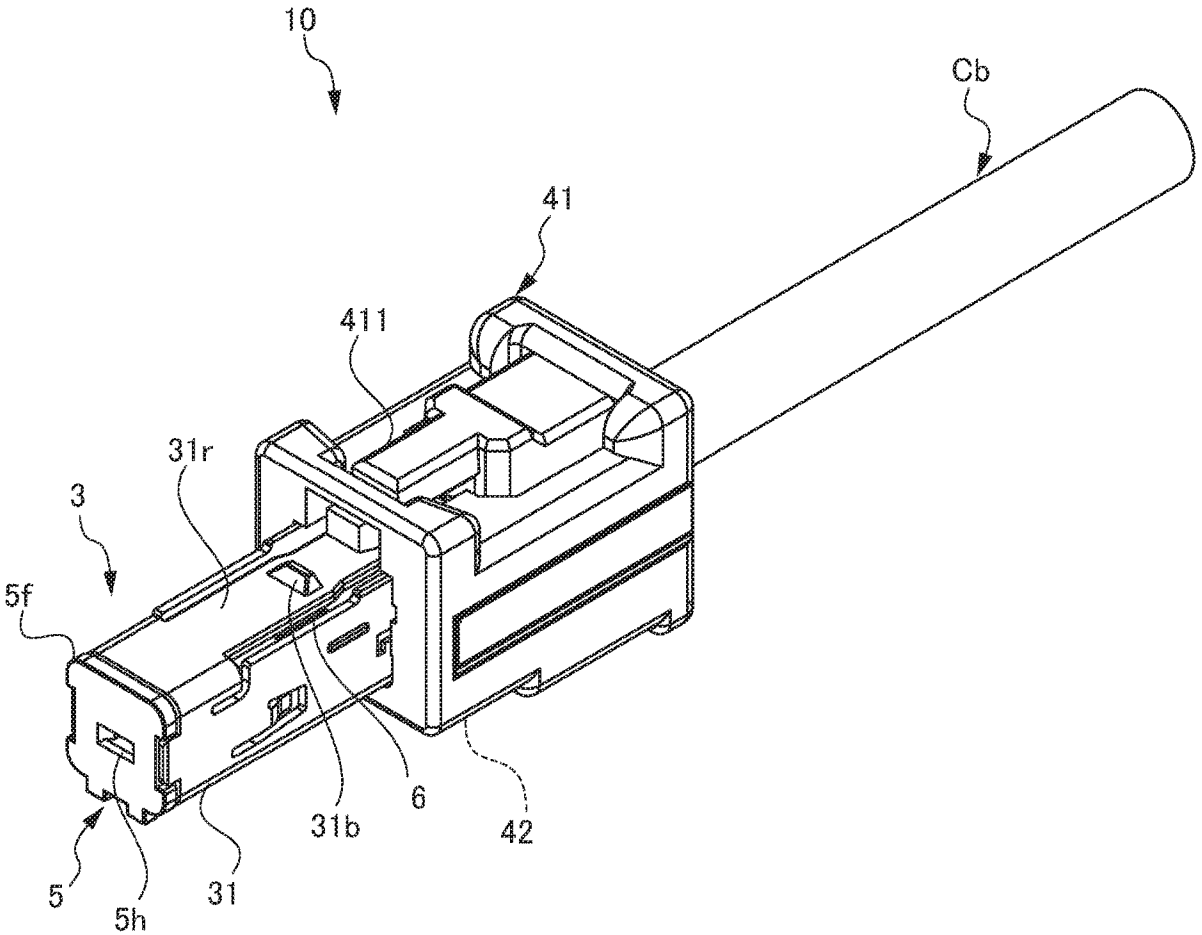
FIG. 1 is an oblique view showing the constitution of the coaxial connector according to one embodiment of the present invention.
Figure 2:
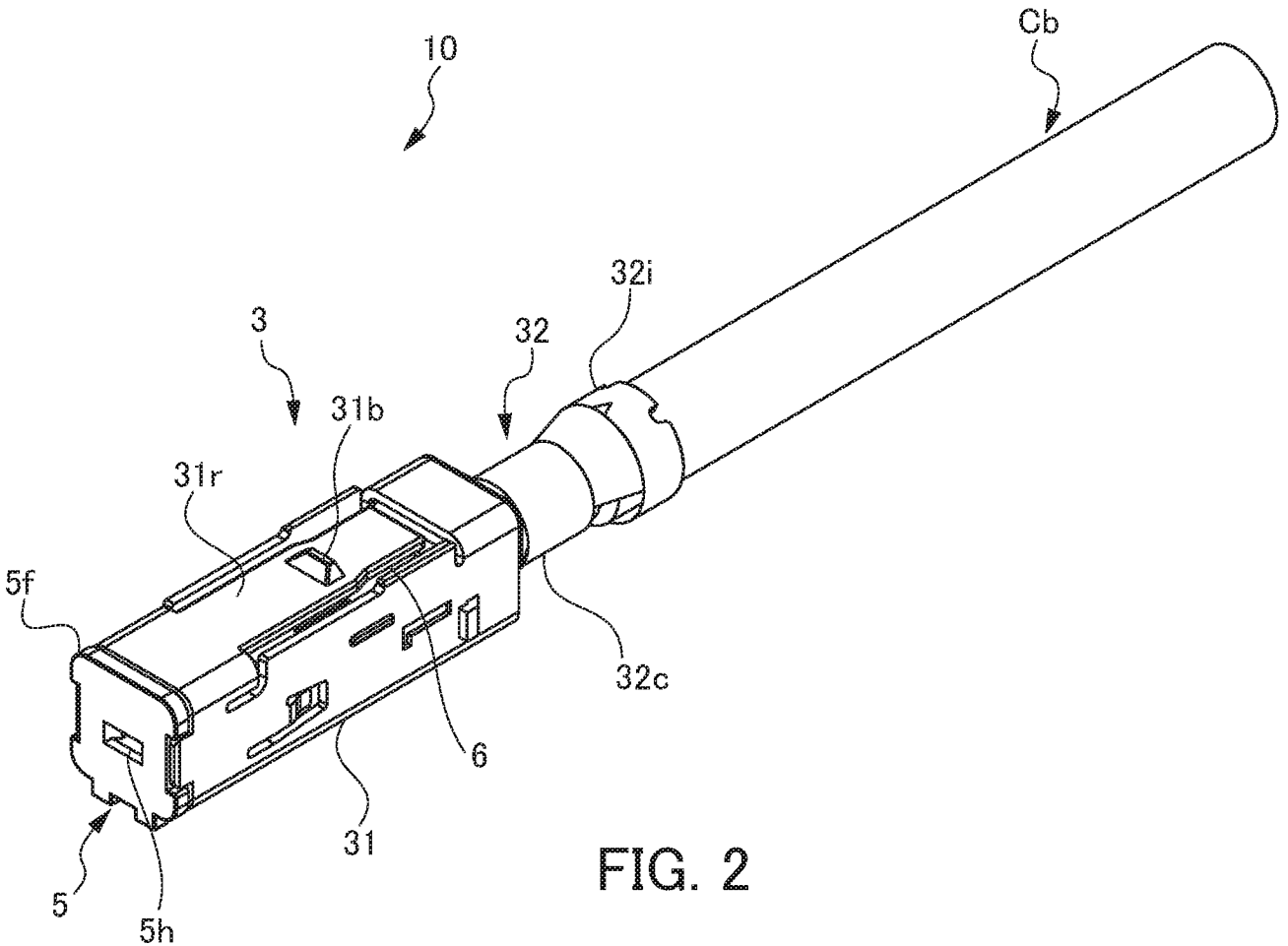
FIG. 2 is an oblique view showing the constitution of the coaxial connector according to this embodiment, and shows a state prior to mounting the external housing.
Figure 3:
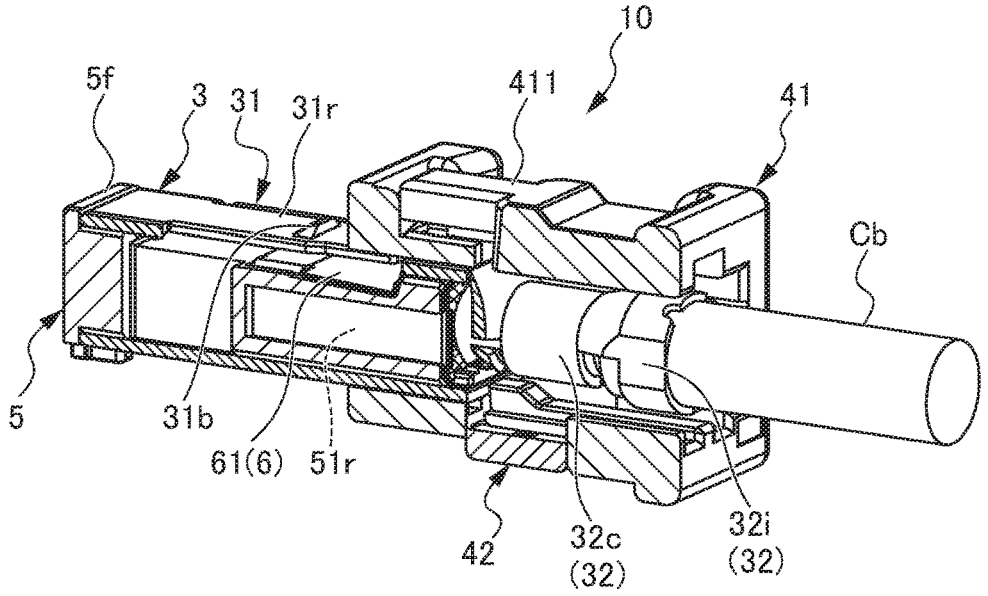
FIG. 3 is a longitudinal sectional oblique view showing the constitution of the coaxial connector according to this embodiment.
Figure 4:
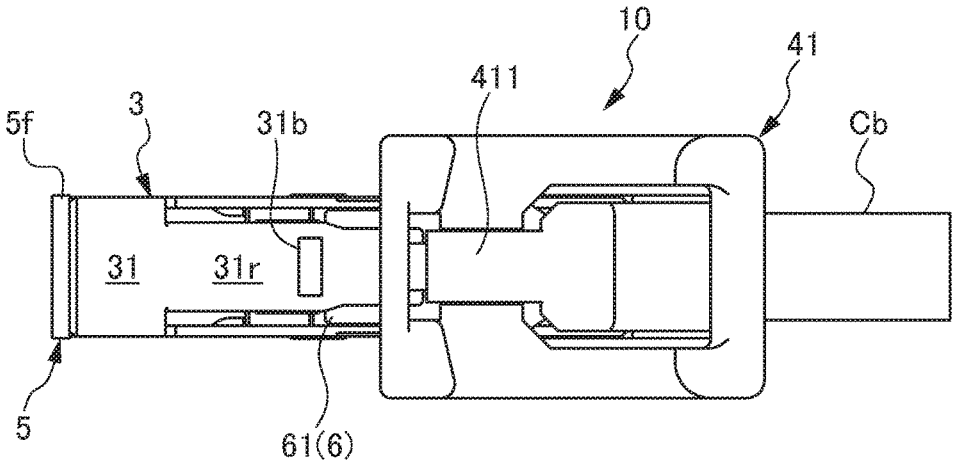
FIG. 4 is a plan view showing the constitution of the coaxial connector according to this embodiment.

FIG. 1 is an oblique view showing the constitution of the coaxial connector according to one embodiment of the present invention. FIG. 2 is an oblique view showing the constitution of the coaxial connector according to this embodiment, and shows a state prior to mounting the external housing. FIG. 3 is a longitudinal sectional oblique view showing the constitution of the coaxial connector according to this embodiment. FIG. 4 is a plan view showing the constitution of the coaxial connector according to this embodiment.

Figure 5:
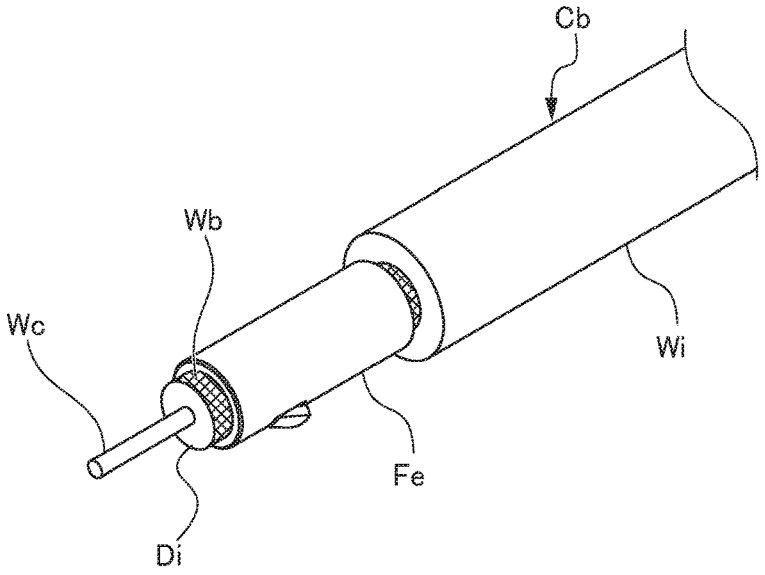
FIG. 5 is an oblique view showing the constitution of the coaxial cable adopted for the coaxial connector according to this embodiment, and shows a state where the end of the coaxial cable has been processed.
Figure 6:
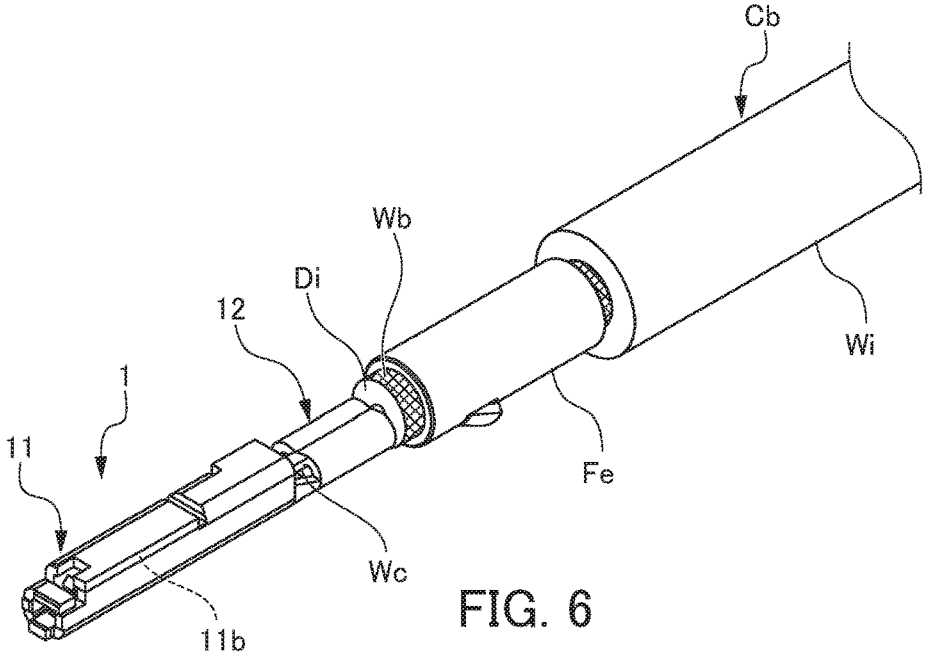
FIG. 6 is an oblique view showing the constitution of the contact provided at the coaxial connector according to this embodiment, and shows a state wherein an end portion of the contact has crimped the core wire of the coaxial cable.
Figure 7:
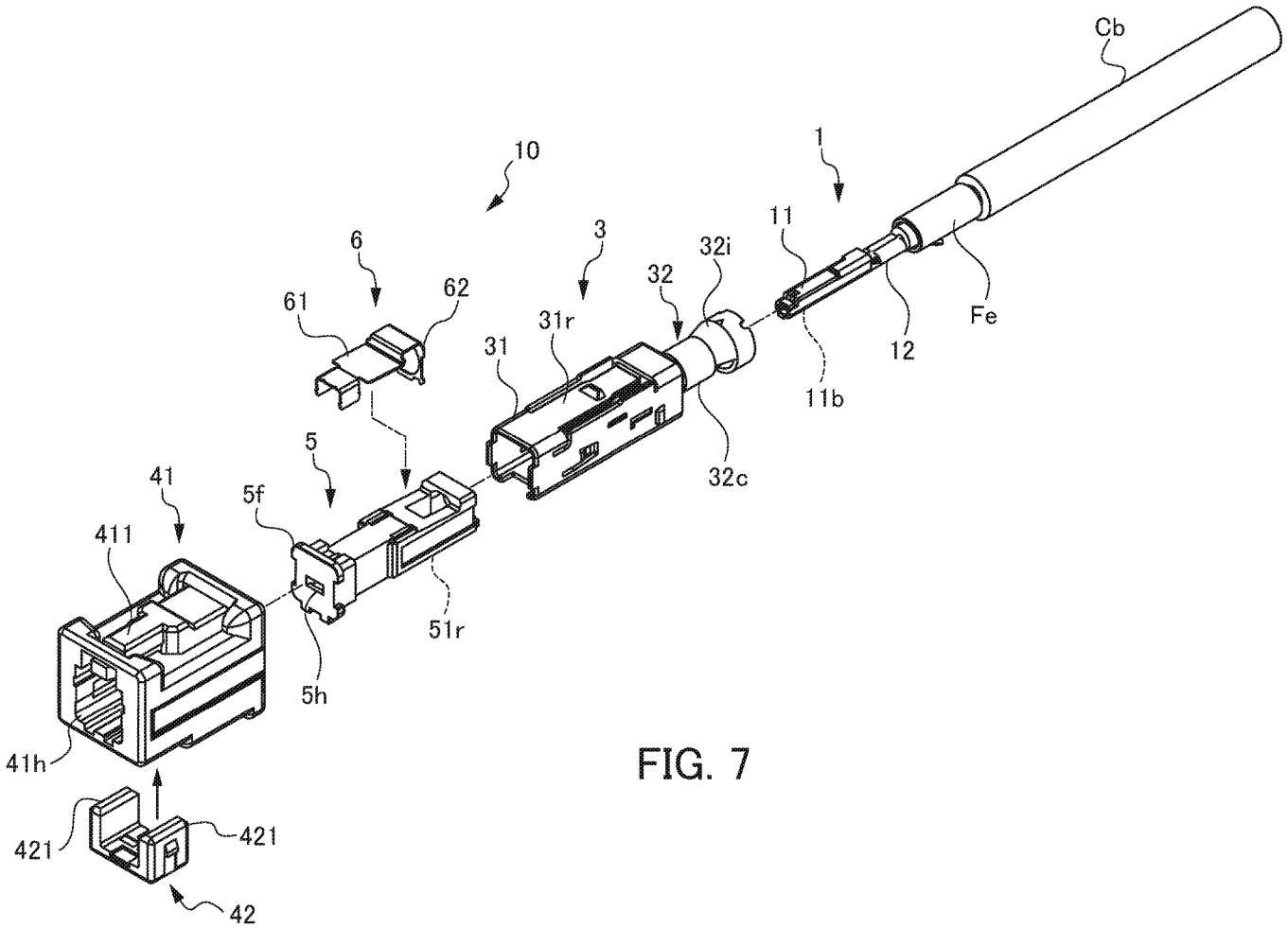
FIG. 7 is an oblique exploded view showing the constitution of the coaxial connector according to this embodiment.
Figure 8A:
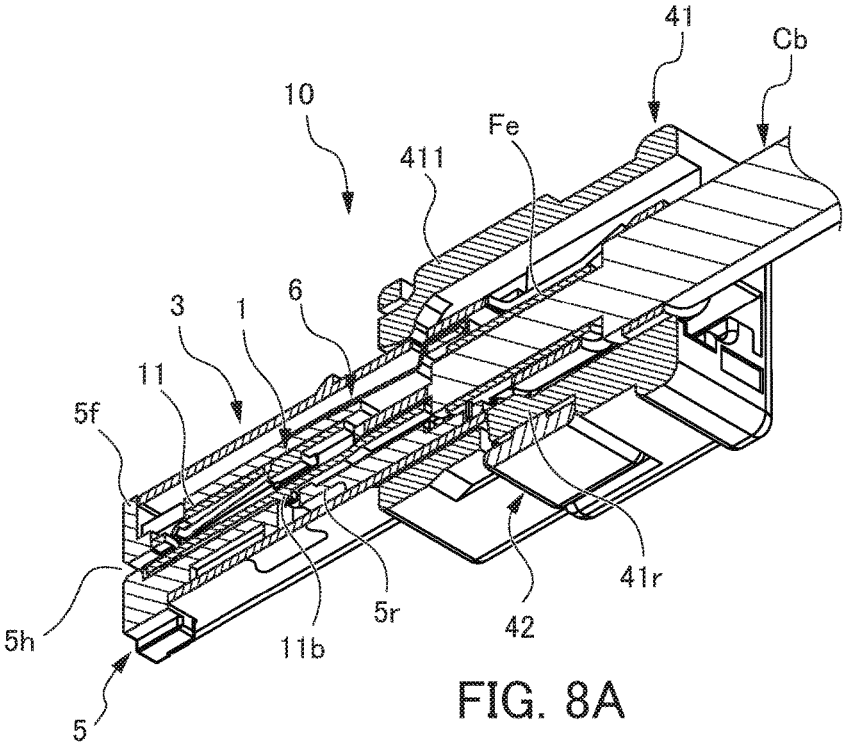
FIG. 8A is an oblique view having a longitudinal section along the center line of the coaxial connector, showing the constitution of the coaxial connector according to this embodiment.
Figure 8B:
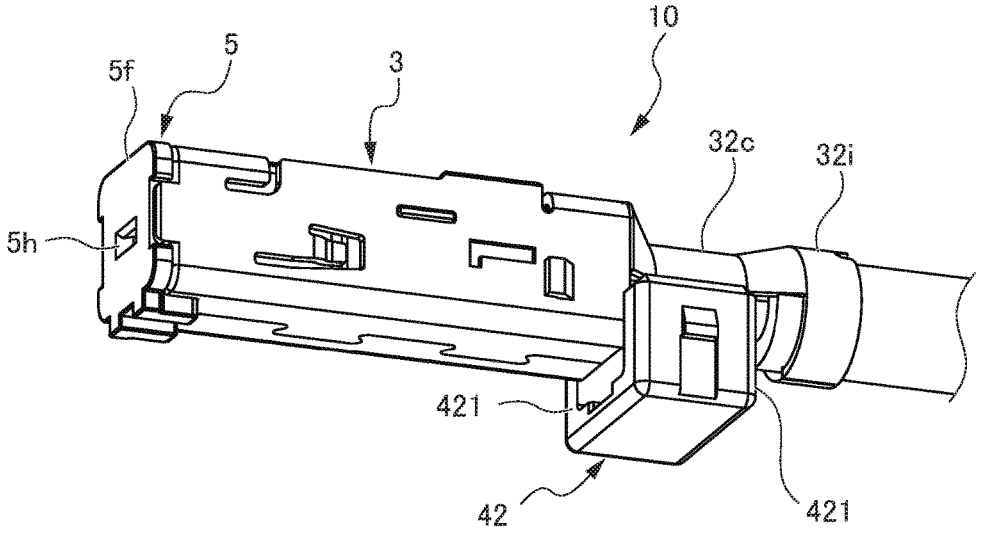
FIG. 8B is an oblique view showing a state wherein an end portion of the shell provided at the coaxial connector according to this embodiment has abutted the retainer.
Figure 9:
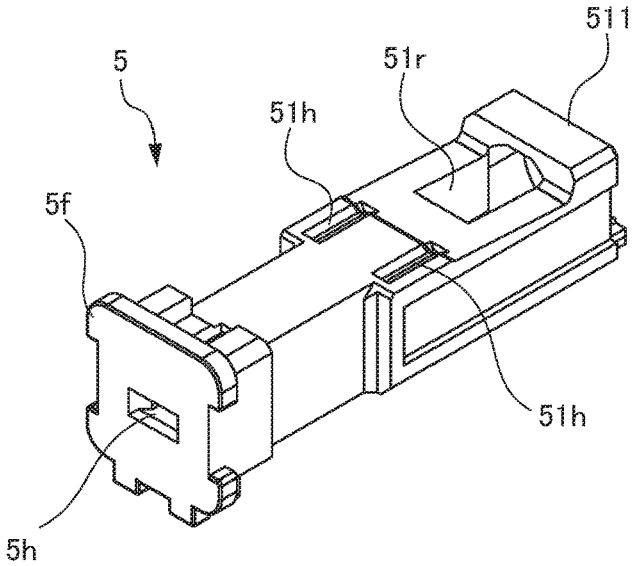
FIG. 9 is an oblique view showing the constitution of the internal housing provided at the coaxial connector according to this embodiment, and shows a state viewed from a front side of the internal housing.
Figure 10:
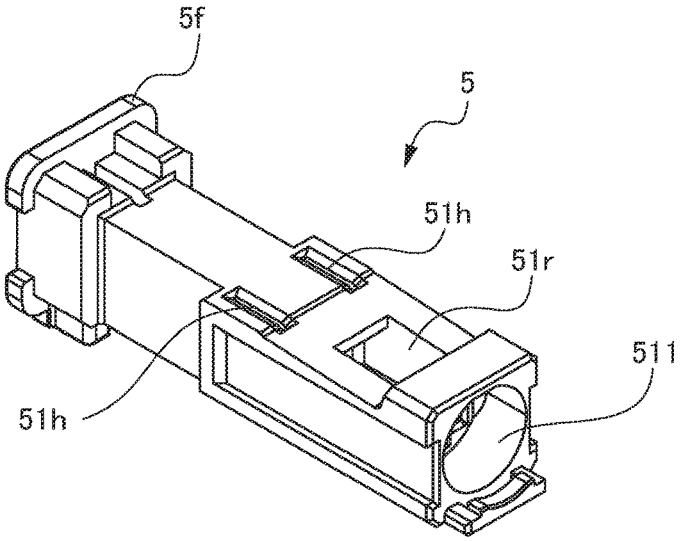
FIG. 10 is an oblique view showing the constitution of the internal housing provided at the coaxial connector according to this embodiment, and shows a state viewed from the rear side of the internal housing.

FIG. 5 is an oblique view showing the constitution of the coaxial cable adopted for the coaxial connector according to this embodiment, and shows a state wherein the end of the coaxial cable has been processed. FIG. 6 is an oblique view showing the constitution of the contact provided at the coaxial connector according to this embodiment, and shows a state wherein an end portion of the contact has crimped the core wire of the coaxial cable. FIG. 7 is an oblique exploded view showing the constitution of the coaxial connector according to this embodiment. FIG. 8A is an oblique view having a longitudinal section along the center line of the coaxial connector, showing the constitution of the coaxial connector according to this embodiment, and FIG. 8B is an oblique view showing a state wherein an end portion of the shell provided at the coaxial connector according to this embodiment has abutted the retainer. FIG. 9 is an oblique view showing the constitution of the internal housing provided at the coaxial connector according to this embodiment, and shows a state viewed from a front side of the internal housing. FIG. 10 is an oblique view showing the constitution of the internal housing provided at the coaxial connector according to this embodiment, and shows a state viewed from the rear side of the internal housing.

Figure 11A:
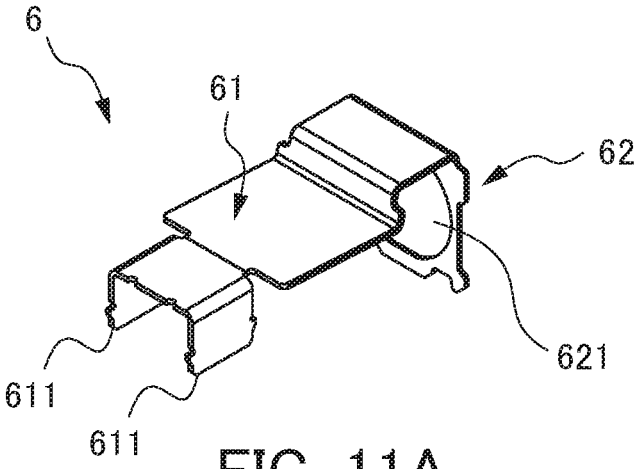
FIG. 11A is an oblique view of the electromagnetic shield plate provided at the coaxial connector according to this embodiment, viewed from an upper face side.
Figure 11B:
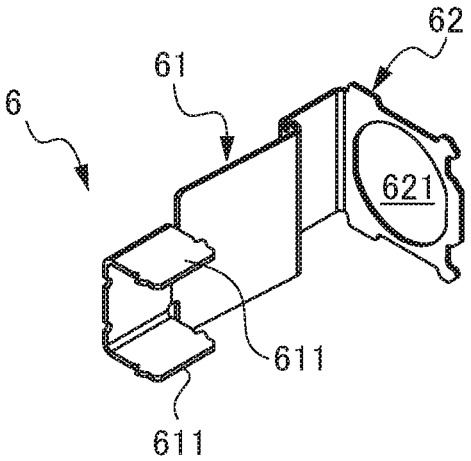
FIG. 11B is an oblique view of the electromagnetic shield plate provided at the coaxial connector according to this embodiment, viewed from a lower face side.
Figure 11C:
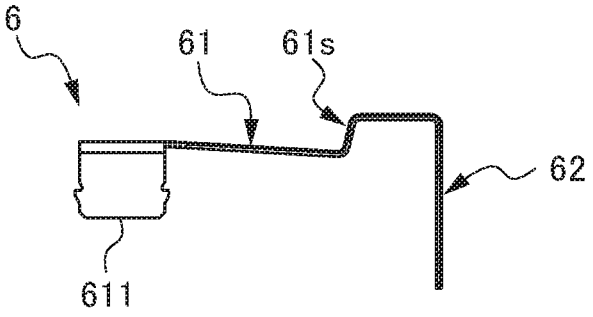
FIG. 11C is right side face view of the electromagnetic shield plate provided at the coaxial connector according to this embodiment.

FIG. 11A to FIG. 11C are views showing the constitution of the electromagnetic shield plate provided at the coaxial connector according to this embodiment, and FIG. 11A is an oblique view, viewed from the upper face side of the electromagnetic shield plate, FIG. 11B is an oblique view, viewed from the lower face side of the electromagnetic shield plate, and FIG. 11C is a right side face view of the electromagnetic shield plate.

Figure 12:
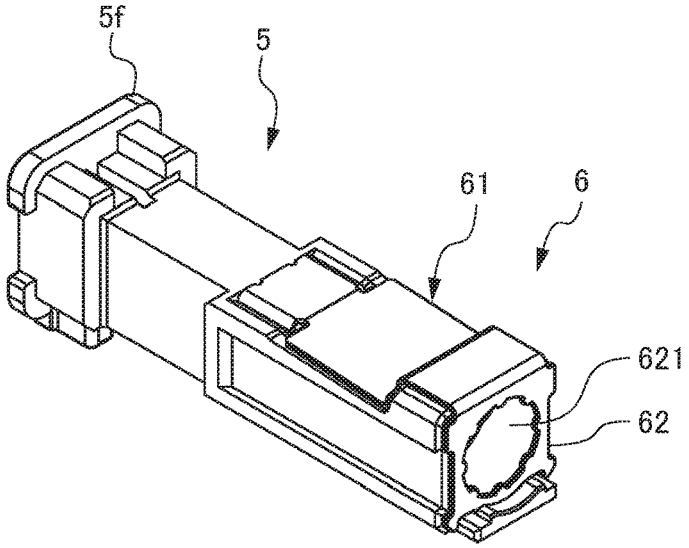
FIG. 12 is an oblique view showing the constitution of the internal housing provided at the coaxial connector according to this embodiment, and shows a state wherein the electromagnetic shield plate is mounted on the internal housing.

FIG. 12 is an oblique view showing the constitution of the internal housing provided at the coaxial connector according to this embodiment, and shows a state wherein the electromagnetic shield plate is mounted on the internal housing.

Figure 13:
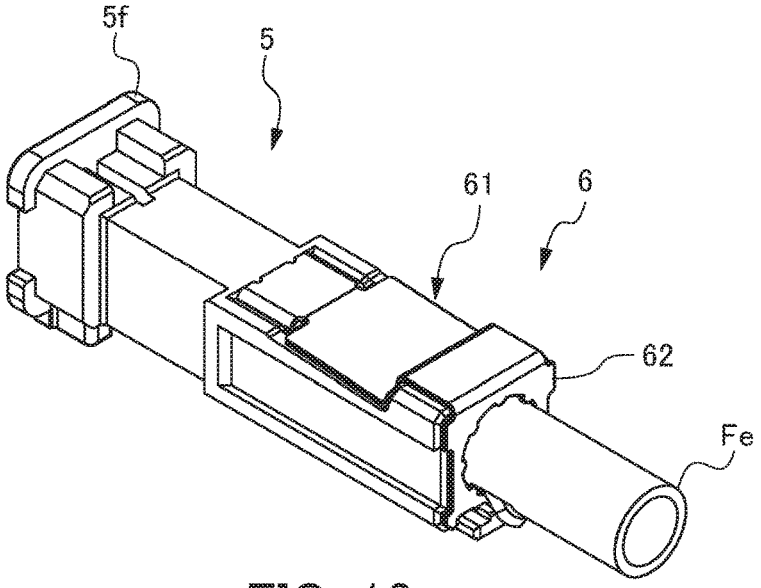
FIG. 13 is an oblique view showing the constitution of the internal housing provided at the coaxial connector according to this embodiment, and shows a state wherein the electromagnetic shield plate is mounted on the internal housing, and the ferrule extends from the rear end portion of the internal housing.

FIG. 13 is an oblique view showing the constitution of the internal housing provided at the coaxial connector according to this embodiment, and shows a state wherein the electromagnetic shield plate is mounted on the internal housing, and the ferrule extends from the rear end portion of the internal housing.

Figure 14:
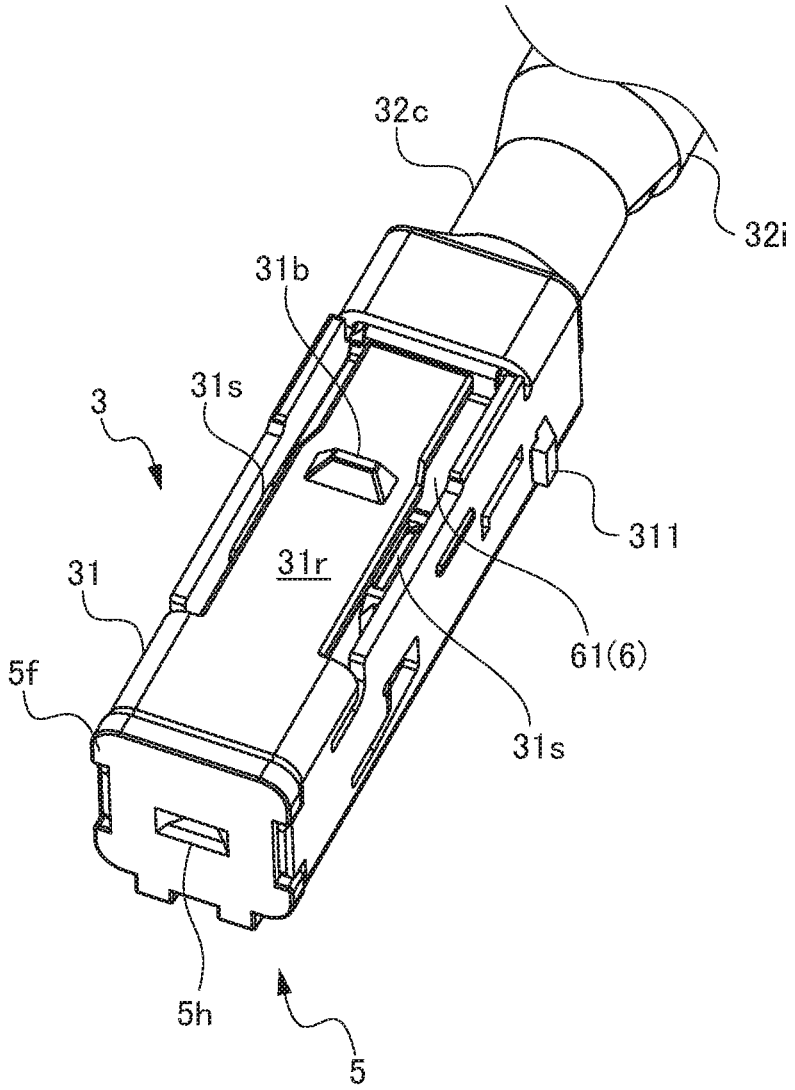
FIG. 14 is an enlarged oblique view of the principal portion of FIG. 2, and shows a state viewed from a front side of the shell provided at the coaxial connector.
Figure 15:
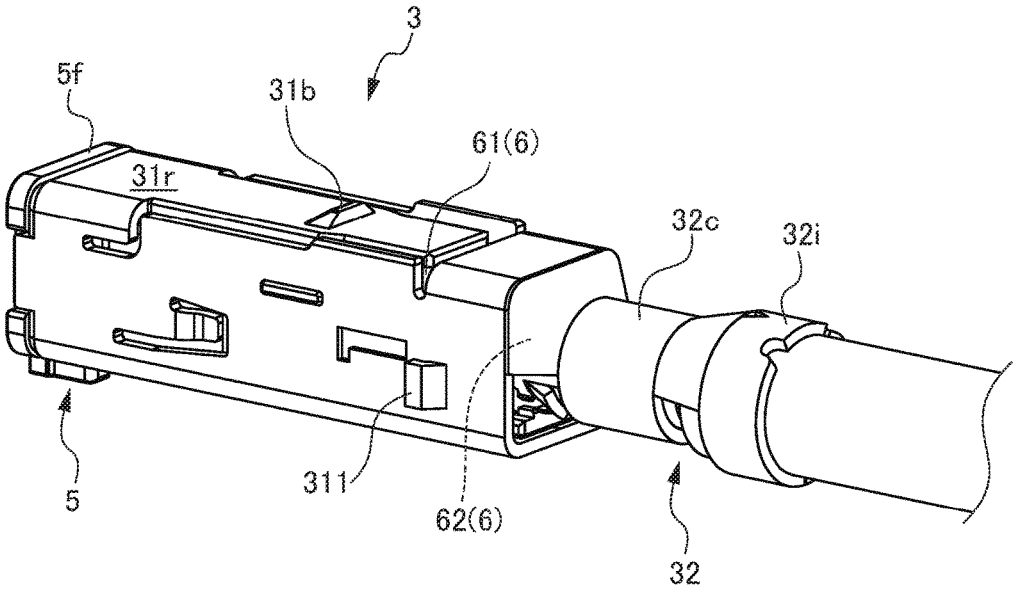
FIG. 15 is an enlarged oblique view of the principal portion of FIG. 2, and shows a state viewed from a rear side of the shell provided at the coaxial connector.

FIG. 14 is an enlarged oblique view of the principal portion of FIG. 2, and shows a state viewed from a front side of the shell provided at the coaxial connector. FIG. 15 is an enlarged oblique view of the principal portion of FIG. 2, and shows a state viewed from a rear side of the shell provided at the coaxial connector.

(Overall Constitution)

With reference to FIGS. 1 to 7, FIGS. 8A to 8B, FIG. 9, FIG. 10, FIGS. 11A to 11C, and FIGS. 12 to 15, in the coaxial connector 10 according to one embodiment of the present invention, an end of the coaxial cable Cb is processed and a predetermined connection terminal portion is formed. The coaxial connector 10 is provided with a contact 1 and a rectangular tube-shaped internal housing 5. Also, the coaxial connector 10 is provided with a shell 3 made of metal and which is the external contact, a rectangular tube-shaped external housing 41, and a concave retainer 42. Further, the coaxial connector 10 is provided with an L-shaped electromagnetic shield plate 6.

With reference to FIG. 5, the coaxial cable Cb is constituted of a circular central conductor Wc consisting of a solid wire or a stranded wire, a dielectric Di of a fluorine-based resin or the like surrounding the perimeter of the central conductor Wc, an outer conductor Wb of a braided wire or the like surrounding the perimeter of the dielectric Di, and an insulation sheath Wi covering and protecting the outer conductor Wb. For the coaxial cable Cb, each constituting member is stripped in advance at a predetermined stripping length from the end thereof. Namely, the end of the coaxial cable Cb is processed.

With reference to FIG. 5 or FIG. 6, the outer conductor Wb is covered by the cylindrical-shaped ferrule Fe having conductivity. The ferrule Fe compresses the dielectric Di via the outer conductor Wb. In this way, the ferrule Fe and the outer conductor Wb are made to be conductive.

With reference to FIG. 6 and FIG. 7, the contact 1 has a rectangular tube-shaped contact connecting portion 11 and a crimping portion 12. The contact connecting portion 11 is formed to have an opening at one end side of the contact 1. The crimping portion 12 which crimps the central conductor We is formed at the other end side of the contact 1. The contact connecting portion 11 and the crimping portion 12 are conductively continuous. The contact connecting portion 11 can be introduced to the interior of the mating contact (not shown in the drawings) from one end side, and can be electrically connected with the mating contact.

With reference to FIG. 7, FIGS. 8A to 8B, FIG. 9, and FIG. 10, the internal housing 5 has in its interior a contact receiving chamber 51*r* opened at a rear end portion. The contact 1 can be inserted into the contact receiving chamber 51*r* in a state where the coaxial cable Cb extends from the contact 1 (refer to FIG. 3).

With reference to FIG. 6, FIG. 7, FIGS. 8A to 8B, FIG. 9, and FIG. 10, the contact 1 has a locking protrusion lib projecting from an external perimeter of the contact connecting portion 11. The housing 5 has a housing lance 5*r* which projects towards the contact receiving chamber 51*r*. When the contact 1 is inserted into the contact receiving chamber 51*r* leading with the contact connecting portion 11, the locking protrusion lib is locked to the housing lance 5*r* whereby the contact 1 can be retained in the internal housing 5 (refer to FIG. 8A).

With reference to FIGS. 1 to 4, FIG. 7, FIG. 14 and FIG. 15, the shell 3 is made by shape processing into a desired shape an expansion plan plate (sheet metal for forming) having conductivity which has been processed into a predetermined shape. The shell 3 is constituted of the rectangular tube-shaped main body 31 and the cable clamp 32. The shell main body 31 covers the external perimeter of the internal housing 5. The cable clamp 32 continuously projects from the shell main body 31, and coaxially fixes the end of the coaxial cable Cb to the shell main body 31.

With reference to FIGS. 3 to 7, the cable clamp 32 comprises the conductor barrel 32*c* and the insulation grip 32*i*. The conductor barrel 32*c* crimps the ferrule Fe, and in this way, the outer conductor Wb and the shell 3 are made to have the same electric potential.

With reference to FIG. 2 or FIG. 3 and FIG. 5, the insulation grip 32*i* crimps the insulation sheath Wi. The insulation grip 32*i*, by crimping the insulation sheath Wi, can fix the end of the coaxial cable Cb to the coaxial connector 10.

With reference to FIGS. 1 to 7 and FIG. 14, the shell main body 31 has a lock piece 31*r* extending from an opening side towards the cable clamp 32, supporting a cantilever shape at its upper face. Both sides of the lock piece 31*r* are a pair of slits 31*s*•31*s* provided at both sides of the upper face of the shell main body 31. Also, the lock piece 31*r* has a locking protrusion 31*b* projecting in a chevron shape at its intermediate portion.

Figure 17:
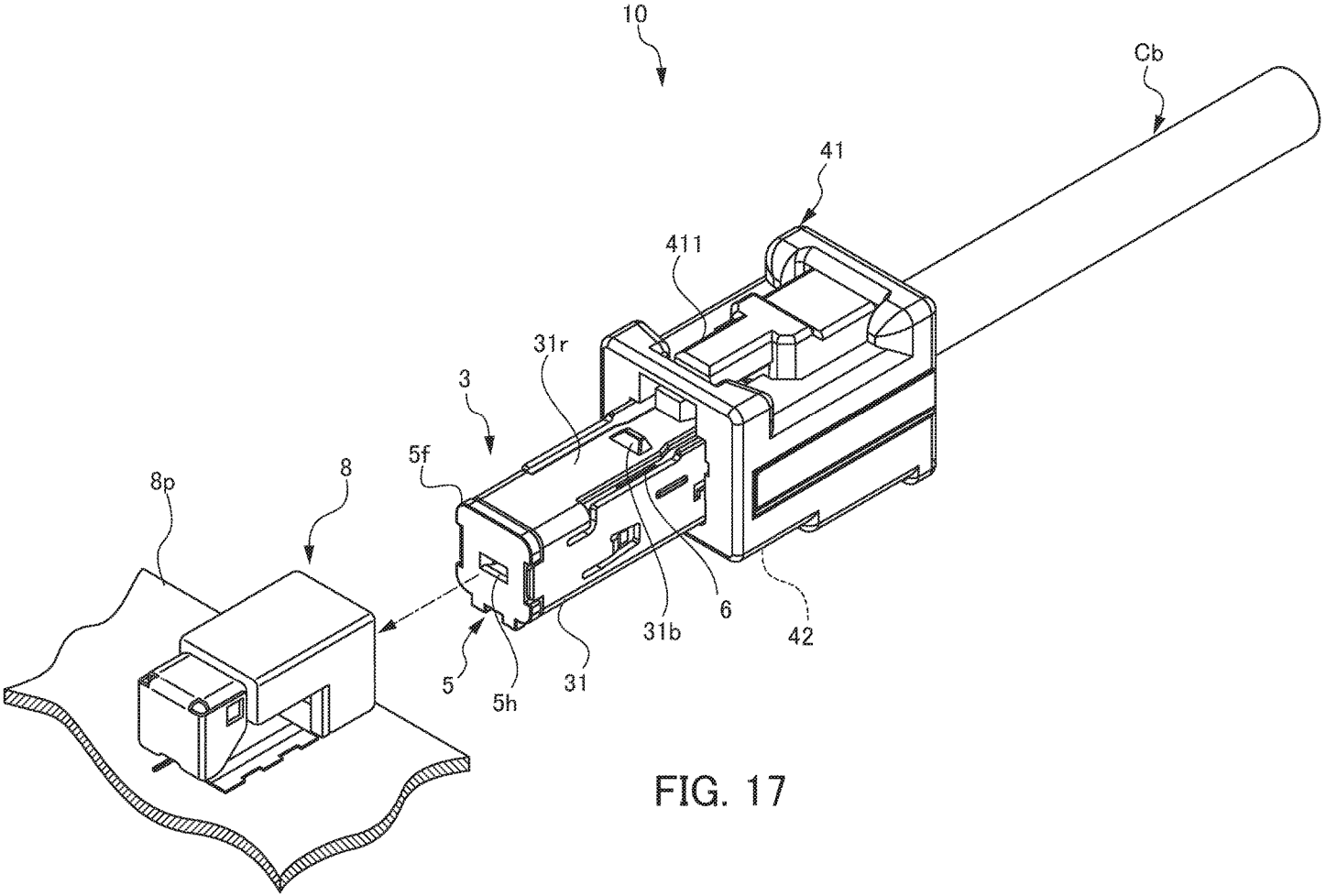
FIG. 17 is an oblique view wherein the coaxial connector according to one embodiment of the present invention, and the receptacle which is the mating connector, are disposed facing each other.

With reference to FIG. 1 or FIG. 17, when the shell main body 31 is inserted to a connecting opening (not shown in the drawings) opened at one face of the receptacle 8 which is the mating connector, the lock piece 31*r* is deformed downwards by the locking protrusion 31*b* being pressed to an inner wall of the connecting opening (not shown in the drawings). When the shell main body 31 is completely inserted into the connecting opening (not shown in the drawings), the lock piece 31*r* elastically returns, and the locking protrusion 31*b* can fit into a locking hole formed at an inner wall of the connecting opening (not shown in the drawings). In this way, the coaxial connector 10 is locked to the receptacle 8.

With reference to FIG. 7, the external housing 41 has in its central portion a rectangular fitting hole 41*h* passing through from one face towards the other face. With reference to FIG. 2 or FIG. 14, the shell main body 31 with the internal housing 5 mounted can be inserted into the fitting hole 41*h* (refer to FIG. 7). As shown in FIG. 8A, by locking the housing lance 41*r* projecting from an internal wall of the lower portion of the external housing 41 to the edge of the shell main body 31, the shell main body 31 is fixed to the external housing 41.

With reference to FIG. 3 or FIG. 7, the retainer 42 can be inserted from the lower face side of the external housing 41 into the external housing 41. The retainer 42 has a pair of restraining pieces 421•421 at both ends. With reference to FIGS. 8A to 8B, in a state wherein the retainer 42 is inserted into the housing 41, the pair of restraining pieces 421•421 abut the edge of the shell main body 31. In this way, the coaxial connector 10 can restrain movement in the axial direction of the shell 3 with respect to the external housing 41.

With reference to FIG. 1 or FIG. 3 and FIG. 17, by a pushing movement operation of the lock release lever 411 disposed at the upper face of the external housing 41, the tip portion of the lock piece 31*r* can be deformed downwards, and the locking of the coaxial connector 10 and the receptacle 8 can be released.

With reference to FIG. 1 or FIG. 17, one end portion of the coaxial connector 10 according to the embodiment can be attached to the coaxial cable Cb. On the other hand, the receptacle 8 can be mounted to a printed circuit board 8p. The other end portion of the coaxial connector 10 is formed by a rectangular tube-shaped shell 3, and therefore, it is easy to miniaturize the receptacle 3.

With reference to FIGS. 11A to 11C, the electromagnetic shield plate 6 preferably consists of a metal plate having conductivity, and an L-shaped electromagnetic shield plate 6 can be obtained by shape processing an expansion plan plate which has been processed into a predetermined shape.

With reference to FIGS. 11A to 11C, FIG. 12 and FIG. 13, the electromagnetic shield plate 6 is constituted of an approximately rectangular one piece 61 and an approximately rectangular other piece 62. The one piece 61 and the other piece 62 are continuous in an approximately orthogonal state. The electromagnetic shield plate 6 sheathes a portion of the internal housing 5 (refer to FIG. 12 or FIG. 13).

With reference to FIGS. 11A to 11C or FIG. 12, the one piece 61 of the electromagnetic shield plate 6 is disposed at an upper face of the internal housing 5. In the case that the one piece 61 is in a direction perpendicular to the other piece 62, it does not simply extend in a horizontal direction. The one piece 61 is provided with a step 61*s* and a moderate incline extending from the step 61*s*. Such a step 61*s* and moderate incline are formed to allow fitting to the upper face of the internal housing 5, as well as to form a deformation margin to allow for deformation of the lower side of the lock piece 31*r*. Thus, the one piece 61 of the electromagnetic shield plate 6 shields the portion of the pair of slits 31*s*•31*s* with respect to the internal housing 5. More specifically, the one piece 61 of the electromagnetic shield plate 6 shields the upper face portion of the internal housing 5 directly below the pair of slits 31*s*•31*s*, and contributes to the electromagnetic shielding effect of the coaxial connector 10.

With reference to FIGS. 1 to 7, FIGS. 8A to 8B, FIG. 9, FIG. 10, FIGS. 11A to 11C, and FIGS. 12 to 15, in the coaxial connector 10 according to the embodiment, the electromagnetic shield plate 6 is disposed at the upper face of the internal housing 5 in which the contact 1 is held. The one piece 61 of the electromagnetic shield plate 6 shields a portion of the pair of slits 31*s*•31*s* of the upper face of the shell main body 31 with respect to the internal housing 5, and therefore, the leakage of noise signals from the contact 1 can be suppressed through the one piece 61 of the electromagnetic shield plate 6, or the input of noise signals to the contact 1 can be suppressed through the one piece 61 of the electromagnetic shield plate 6.

With reference to FIG. 9 or FIG. 10, the internal housing 5 has a first circular opening 511 passing through the contact receiving chamber 51*r*. The first circular opening 511 is opened at a rear end portion of the internal housing 5. The outer conductor Wb is introduced into the first circular opening 511 from an axial direction. With reference to FIG. 13, the embodiment is constituted such that, when the ferrule Fe which compresses the outer conductor Wb is introduced into the first circular opening 511 from the axial direction, it passes through the electromagnetic shield plate 6.

With reference to FIGS. 11A to 11C, FIG. 12, and FIG. 13, a second circular opening 621 is opened at the other piece 62 of the electromagnetic shield plate 6. The other piece 62 of the electromagnetic shield plate 6 is disposed at a rear end portion of the internal housing 5. The second circular opening 621 is disposed concentrically with the first circular opening 521. Further, the other piece 62 of the electromagnetic shield plate 6 shields the rear end portion of the internal housing 5. More specifically, the other piece 62 of the electromagnetic shield plate 6 contributes to the shielding effect of the coaxial connector 10 by shielding a portion of the circumference of the first circular opening 511 of the internal housing 5.

With reference to FIGS. 1 to 7, FIGS. 8A to 8B, FIG. 9, FIG. 10, FIGS. 11A to 11C, and FIGS. 12 to 15, in the coaxial connector 10 according to the embodiment, the electromagnetic shield plate 6 is disposed at the rear end portion of the internal housing 5 in which the contact 1 is held. The other piece 62 of the electromagnetic shield plate 6 shields the rear end portion of the internal housing 5, and therefore, the leakage of noise signals from the contact 1 can be suppressed through the other piece 62 of the electromagnetic shield plate 6, or the input of noise signals to the contact 1 can be suppressed through the other piece 62 of the electromagnetic shield plate 6.

(Constitution of the Internal Housing)

Next, the constitution of the internal housing according to the embodiment is explained. With reference to FIGS. 1 to 7, FIGS. 8A to 8B, FIG. 9, and FIG. 10, the internal housing 5 preferably consists of an insulator, and may be obtained by molding a synthetic resin having insulating properties to obtain the rectangular tube-shaped internal housing 5.

With reference to FIG. 1 to FIG. 4 and FIG. 14, the internal housing 5 has a flange 5*f* and a rectangular insertion opening 5*h* at a front end side. The internal housing 5 can be inserted into the shell main body 31 from the rear end side which is the opposite side of the flange 5*f*. Further, by abutting the flange 5*f* to the edge of the shell main body 31, the internal housing 5 is positioned with respect to the shell main body 31.

With reference to FIG. 6, FIG. 7, and FIGS. 8A to 8B, the contact connecting portion 11 is disposed inside the internal housing 5 so as to face the insertion opening 5*h*. The mating side connector (not shown in the drawings) can be introduced into the insertion opening 5*h*. Thus, the contact connection portion 11 can be electrically connected with the mating side connector.

As shown in FIG. 9, FIG. 10, FIG. 12, and FIG. 13, the internal housing 5 according to the embodiment has a constitution such that the one piece 61 of the electromagnetic shield plate 6 may be disposed at its upper face. Also, the internal housing 5 according to the embodiment is constituted such that the other piece 62 of the electromagnetic shield plate 6 can be disposed at its rear end portion.

With reference to FIG. 9 or FIG. 10, the internal housing 5 includes a pair of indented holes 51*h*•51*h* piercing the upper face. On the other hand, with reference to FIGS. 11A to 11C, the electromagnetic shield plate 6 includes a pair of pressing pieces 611•611 formed at an end portion of the one piece 61. By pressing the pair of pressing pieces 611•611 into the pair of indented holes 51*h*•51*h*, the electromagnetic shield plate 6 can be fixed to the internal housing 5 (refer to FIG. 12 or FIG. 13).

(Function of the Coaxial Connector)

Next, the function and effects of the coaxial connector according to the embodiment will be explained. With reference to FIGS. 1 to 7, FIGS. 8A to 8B, FIG. 10, FIGS. 11A to 11C, and FIGS. 12 to 15, the coaxial connector 10 is provided with an internal housing 5 equipped with an electromagnetic shield plate 6. In this way, the one piece 61 of the electromagnetic shield plate 6 is disposed at an upper face of the internal housing 5 in which the contact 1 is held, and a portion of the pair of slits 31*s*•31*s* of the upper face of the shell 3 is shielded with respect to the internal housing 5, and therefore, the leakage of noise signals from the contact 1 can be suppressed through the one piece 61 of the electromagnetic shield plate 6, or the input of noise signals to the contact 1 can be suppressed through the one piece 61 of the electromagnetic shield plate 6.

Further, in the internal housing 5 equipped with the electromagnetic shield plate 6, the other piece 62 of the electromagnetic shield plate 6 is disposed at the rear end portion of the internal housing 5 in which the contact 1 is held. In this way, the rear end portion of the internal housing 5 is shielded, and therefore, the leakage of noise signals from the contact 1 can be suppressed through the other piece 62 of the electromagnetic shield plate 6, or the input of noise signals to the contact 1 can be suppressed through the other piece 62 of the electromagnetic shield plate 6.

Furthermore, the coaxial connector 10 according to the embodiment can utilize a constitution of the prior art with respect to the shell 3 and the external housing 41, and therefore, it maintains compatibility with the receptacle 8 which is the mating connector.

(Modified Examples of the Constitution and their Function)

Figure 16A:
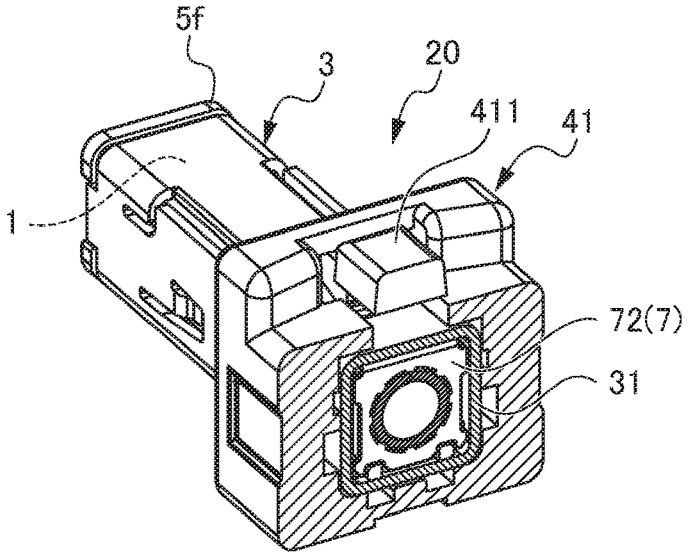
FIG. 16A is an oblique view having a transverse section of the coaxial connector, and shows the constitution of the coaxial connector according to a modified example of the embodiment of the present invention.
Figure 16B:
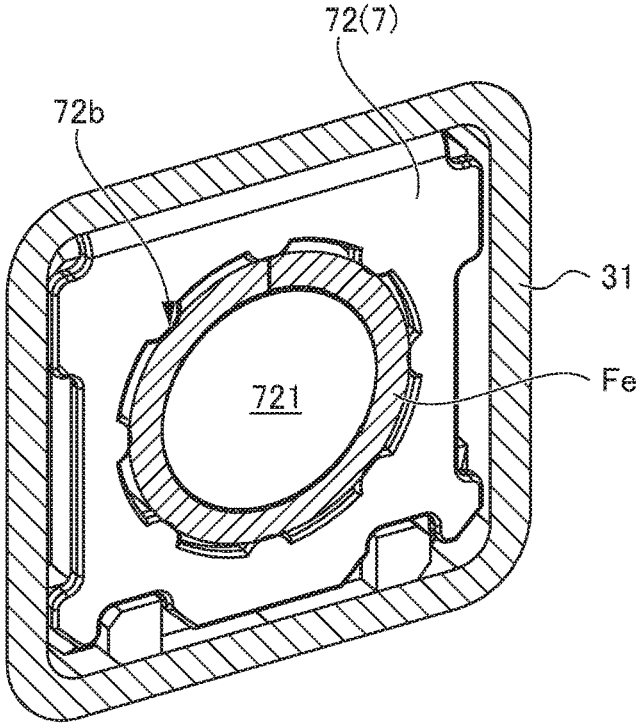
FIG. 16B is an enlarged transverse sectional view of the principal portion of FIG. 16A.

Next, the constitution of the coaxial connector according to modified examples of the present invention and their function are explained. FIG. 16A shows the constitution of a coaxial connector according to an embodiment of a modified example of the present invention, and is an oblique view having a transverse section of the coaxial connector. FIG. 16B is an enlarged transverse sectional view of the principal portion of FIG. 16A.

The coaxial connector 20 according to the modified example, in the same way as the above described embodiment, is provided with a contact 1 and a rectangular tube-shaped internal housing 5. Also, the coaxial connector 20 is provided with a shell 3 made of metal and which is the external contact, a rectangular tube-shaped external housing 41, and a concave retainer 42. Further, the coaxial connector 20 is provided with an L-shaped electromagnetic shield plate 7.

With reference to FIGS. 16A to 16B, the electromagnetic shield plate 7 is constituted of one piece (not shown in the drawings) of an approximately rectangular shape, and another piece 72 of an approximately rectangular shape, and sheathes a portion of the internal housing 5. The one piece (not shown in the drawings) and the other piece 72 are continuous in an approximately orthogonal state. The one piece (not shown in the drawings) of the electromagnetic shield plate 7 shields an upper face of the internal housing 5. The other piece 72 of the electromagnetic shield plate 7 is disposed at a rear end portion of the internal housing 5.

A second circular opening 721 is opened at the other piece 72 of the electromagnetic shield plate 7 (refer to FIG. 16B). The second circular opening 721 is disposed concentrically with the first circular opening 511 (refer to FIG. 10). Thus, the other piece 72 of the electromagnetic shield plate 7 electromagnetically shields the rear end portion of the internal housing 5.

With reference to FIG. 16B, the electromagnetic shield plate 7 has a plurality of projecting pieces 72*b*1 intermittently projecting from an internal perimeter of the second circular opening 721. These projecting pieces 72*b* contact an external perimeter of the ferrule Fe from an external perimeter direction of the ferrule Fe. In this way, the outer conductor Wb and the electromagnetic shield plate 7 can be made to have the same potential, and the rear end portion of the internal housing 5 can be securely electromagnetically shielded.

The coaxial connector 20 according to the modified example can provide similar effects to the coaxial connector 10 according to the embodiment, and can securely electromagnetically shield the rear end portion of the internal housing 5.

While preferred embodiments of the present invention have been described and illustrated above, it is to be understood that they are exemplary of the invention and are not to be considered to be limiting. Additions, omissions, substitutions, and other modifications can be made thereto without departing from the spirit or scope of the present invention. Accordingly, the invention is not to be considered to be limited by the foregoing description and is only limited by the scope of the appended claims.

What is claimed is:

1. A coaxial connector constituting a connecting terminal at an end of a coaxial cable having a central conductor, a dielectric enclosing the central conductor, an outer conductor covering the dielectric, and an insulation sheath covering the outer conductor, comprising:

a contact which is connectable with a mating contact, and which has at one end side a contact connecting portion, and which has at an other end side a crimping portion which can crimp the central conductor, a rectangular tube-shaped internal housing having in its interior a contact receiving chamber which is opened at a rear end portion and which can receive the contact connecting portion with the contact connecting portion as the head, and which retains the contact in the contact receiving chamber, an electrically conductive shell having a rectangular tube-shaped shell main body covering an external circumference of the internal housing, and a cable clamp which continuously projects from the shell main body and which can coaxially fix an end of the coaxial cable to the shell main body, and an L-shaped electromagnetic shield plate interposed between the shell and the internal housing and which sheathes a part of the internal housing, wherein:

the cable clamp comprises a conductor barrel which can crimp the outer conductor, and an insulation grip which can crimp the insulation sheath, the shell main body has a pair of slits at both sides of an upper face, and has a lock piece supported with a cantilever shape at the upper face, and the electromagnetic shield plate is disposed at an upper face of the internal housing, and has one piece which shields a portion of the pair of slits with respect to the internal housing.

2. The coaxial connector according to claim 1, wherein a rear end portion of the internal housing comprises a first circular opening communicating to the contact receiving chamber, and into which the outer conductor can be introduced from an axial direction, and the electromagnetic shield plate further comprises an other piece having a second circular opening disposed concentrically with the first circular opening, at a rear end portion of the internal housing, and which can shield the rear end portion of the internal housing.

3. The coaxial connector according to claim 2, wherein for the electromagnetic shield plate, the one piece and the other piece are continuous in an approximately orthogonal state.

4. The coaxial connector according to claim 1, further comprising a rectangular tube-shaped external housing fixed to a rear end side of the shell main body, and having in its central portion a fitting hole into which the shell main body can be inserted, and wherein the external housing has a lock release lever which can be pushed and moved at a front portion of the lock piece.

5. The coaxial connector according to claim 2, further comprising a rectangular tube-shaped external housing fixed to a rear end side of the shell main body, and having in its central portion a fitting hole into which the shell main body can be inserted, and the external housing has a lock release lever which can be pushed and moved at a front portion of the lock piece.

6. The coaxial connector according to claim 2, wherein the coaxial cable further has a barrel-shaped ferrule having conductivity and which compresses the dielectric via the outer conductor, and the electromagnetic shield plate, at the other piece, has one or more projecting pieces intermittently projecting from an internal perimeter of the second circular opening, and contacting an external perimeter of the ferrule from an external perimeter direction of the ferrule.

* * * * *